US005616273A

United States Patent [19]

Clark et al.

[11] Patent Number: 5,616,273

[45] Date of Patent: Apr. 1, 1997

[54] SYNERGISTIC SURFACTANT COMPOSITIONS AND FIRE FIGHTING CONCENTRATES THEREOF

[75] Inventors: Kirtland P. Clark, Bethel, Conn.; Eduard K. Kleiner, Pound Ridge, N.Y.

[73] Assignee: Dynax Corporation, Elmsford, N.Y.

[21] Appl. No.: 289,060

[22] Filed: Aug. 11, 1994

[51] Int. Cl.[6] ..... A62D 1/00

[52] U.S. Cl. ..... 252/2; 252/3; 252/8.05; 252/355

[58] Field of Search ..... 252/3, 8.05, 2, 252/8, 354, 355, 545, 547, 153, 549, 174.23; 562/34, 574

[56] References Cited

U.S. PATENT DOCUMENTS

| | | | |
|---|---|---|---|
| 3,562,156 | 2/1971 | Francen | 252/8.05 |
| 3,772,195 | 11/1973 | Francen | 252/8.05 |
| 3,957,657 | 5/1976 | Chiesa, Jr. | 252/3 |
| 4,089,804 | 5/1978 | Falk | 252/355 |
| 4,183,367 | 1/1980 | Goebel et al. | 132/202 |
| 4,188,307 | 2/1980 | Batheit | 252/355 |
| 4,209,456 | 6/1980 | Billenstein et al. | 558/27 |
| 4,283,533 | 8/1981 | Richter | 544/171 |
| 4,350,206 | 9/1982 | Hoffmann et al. | 169/47 |
| 4,359,096 | 11/1982 | Berger | 169/44 |
| 4,430,272 | 2/1984 | Ehrl et al. | 252/2 |
| 4,459,221 | 7/1984 | Hisamoto et al. | 252/3 |
| 4,999,119 | 3/1991 | Norman et al. | 252/3 |
| 5,085,786 | 2/1992 | Alm et al. | 252/8.05 |
| 5,391,721 | 2/1995 | Hanen et al. | 252/3 |

FOREIGN PATENT DOCUMENTS

| | | |
|---|---|---|
| 2198788 | 3/1989 | Australia . |

*Primary Examiner*—Sharon Gibson
*Assistant Examiner*—Joseph D. Anthony
*Attorney, Agent, or Firm*—Mathews, Woodbridge & Collins

[57] ABSTRACT

This invention relates to synergistic surfactant compositions based on water insoluble amphoteric fluorochemical surfactants and water soluble anionic hydrocarbon or fluorochemical surfactants of the sulfate or sulfonate type and aqueous film forming foam agents derived from such synergistic surfactant compositions and a method to treat the aqueous waste stream generated by such aqueous film forming foam agents.

28 Claims, No Drawings

SYNERGISTIC SURFACTANT COMPOSITIONS AND FIRE FIGHTING CONCENTRATES THEREOF

BACKGROUND OF INVENTION

The instant invention relates to novel fire fighting concentrates which are derived from novel synergistic surfactant compositions and which upon dilution with fresh or sea water and aeration produce aqueous film forming foams capable of extinguishing non-polar and polar solvent and fuel fires.

Fire fighting foam concentrates which produce aqueous film forming foams are known a) as AFFF agents (for Aqueous Film Forming Foam) if they have the capability of extinguishing non-polar solvent or fuel fires and b) as AR-AFFF agents (for Alcohol Resistant AFFF agent) if they have the capability of extinguishing polar as well as non-polar solvent or fuel fires. Aqueous film forming foams are the most efficient fire fighting agents because they act in the following two ways as outlined in U.S. Pat. No. 4,472,286:

a) As aqueous foams they are used as primary fire extinguishing agents and b) As aqueous film formers they act as vapor supressors, augmenting the fire-extinguishing efficiency of the foam and preventing re-ignition of fuel or solvent vapors.

It is the second property which makes AFFF and AR-AFFF agents far superior to other known fire fighting agents. With AFFF and AR-AFFF agents, the vapor sealing action on non-polar solvents and fuels is achieved by the spreading of the aqueous agent solution draining from the foam onto the non-polar solvent and fuel surfaces, while with AR-AFFF agents, the vapor sealing action on polar solvents and fuels is achieved by the precipitation of a polymer film from a polymer solution draining from the foam onto the polar solvent surface and the spreading of the aqueous film forming solution, also draining from the AR-AFFF foam, over the surface of the precipitated polymer film.

The criterion necessary to attain spontaneous spreading of two immiscible liquids has been taught by Harkins et al, *Journal of American Chemistry*, 44, 2665 (1922).

The measure of the tendency for spontaneous spreading of an aqueous solution over the surface of non-polar solvents such as hydrocarbons is defined by the spreading coefficient (SC) and can be expressed as follows:

$SC_{a/b}=Y_b-Y_a-Y_i$, where $SC_{a/b}$=Spreading coefficient $Y_b$=Surface tension of the lower hydrocarbon fuel phase, $Y_a$=Surface tension of the upper aqueous phase, $Y_i$=Interfacial tension between the aqueous upper phase and the lower hydrocarbon phase.

If the SC is positive, an aqueous solution should spread and film formation on top of the hydrocarbon surface should occur. The more positive the SC, the greater the spreading tendency will be. Based on the above equation by Harkins, it is obvious that the most efficient surface tension depressants will yield aqueous film forming solutions having the highest spreading coefficient.

While lowering the interfacial tension will also increase the spreading coefficient, it is desirable not to lower the interfacial tension below 1.0 dyne/cm in order to avoid emulsification of non-polar solvents and fuels.

For example, if a hydrocarbon fuel has a surface tension of 20 dynes/cm and an aqueous solution has a surface tension of 16 dynes/cm and the interfacial tension between the two immiscible liquids is 1.0 dyne/cm, then the spreading coefficient (SC) will be +3 (SC=20–16–1=3) and therefore film formation will occur.

Today's AFFF and AR-AFFF agents contain one or more fluorochemical surfactants providing the desired low surface tension of 15 to 18 dynes/cm, one or more hydrocarbon surfactants, providing the desired interfacial tension of 1 to 5 dynes/cm as well as the desired foam properties such as foam expansion, foam fluidity and foam drainage, fluorochemical synergists to improve the efficiency of fluorochemical surfactants, foam stabilizers, solvents, electrolytes, pH buffers, corrosion inhibitors and the like. In addition to the above components in AFFF agents, AR-AFFF agents contain one or more water-soluble polymers which precipitate on contact with a polar solvent or fuel, providing a protective polymer film at the interface between fuel and the aqueous film forming foam. Many U.S. patents describe the composition of AFFF agents as summarized in U.S. Pat. No. 4,999,119. Additional AFFF agent compositions are also described in U.S. Pat. Nos. 4,420,434; 4,472,286; 5,085,786 and 5,218,021.

Compositions of AR-AFFF agents are described in U.S. Pat. Nos. 4,060,489; 4,149,599; 4,387,032 and 4,999,119. in U.S. Pat. Nos. 4,472,286 and 5,085,786, summaries of the development from the beginning of AFFF agent development in the mid-1960s to today's highly efficient AFFF agents are presented.

During the past 25 years, the efficiency of AFFF agents has been significantly improved with the development of formulations based on more efficient fluorochemical and hydrocarbon surfactants, synergists and other additives. And with the invention of the AR-AFFF agents, truly universal type aqueous film forming foam agents can now fight any type of fuel or solvent fire.

What has not changed during this long development period of AFFF and AR-AFFF agent is the general use of fluorochemical surfactants broadly defined as water-soluble fluoroaliphatic surfactants represented by the formula $R_fQ_mZ$ (U.S. Pat. Nos. 3,562,156 and 3,772,195) and $(R_f)_n$-$(Q)_mZ$ (U.S. Pat No. 4,795,590) wherein $R_f$ is a fluoroaliphatic radical, Z is a water-solubilizing polar group and Q is a suitable linking group. Because AFFF agents are diluted or proportioned with water, fluorochemical surfactants suitable for AFFF agents were required to be water soluble. Water-solubility of fluorochemical surfactants was defined in U.S. Pat. Nos. 3,562,156 and 3,772,195 in such a way that the combination of the fluoroaliphatic radical and the water solubilizing group be so balanced as to provide a solubility in water at 25° C. of a least 0.01 percent by weight and preferably 0.15 percent, particularly in the case where an aqueous film forming foam concentrate had to be prepared. As shown in the recent U.S. Pat. No. 5,085,786, the definition of water-solubility of fluorochemical surfactants for use in AFFF agents has not changed. Minimum solubility at 25° C. in water is still defined as at least 0.01 percent by weight and preferably at least about 0.05 percent by weight.

Today's AFFF and AR-AFFF agents have to meet different fire performance specifications and do, therefore, have different contents of fluorochemical surfactants and of other components. Solutions, also referred to as premixes, made up from today's commercial AFFF and AR-AFFF agents used to generate aqueous film forming foams have fluorine contents ranging from 0.02 to 0.044 percent, depending on the efficiency of fluorochemical surfactants utilized and depending on required performance specifications. Since fluorochemical surfactants, depending on the structure have fluorine contents in the approximate range of about 40 to 70 percent by weight, the fluorochemical surfactant contents in such AFFF and AR-AFFF solutions or premixes can range from as low as 0.029 to as high as 0.11 percent.

This indicates that the actual solubility of fluorochemical surfactants in water, useful for use in AFFF and AR-AFFF agents has to be approximately 3 to 11 times higher than the minimum water solubility as defined in the above mentioned U.S. patents.

Today's AFFF and AR-AFFF agents are concentrates of the 6%, 3% or 1% type. These agent designations indicate that in the case of a 6% AFFF agent, 6 parts of agent have to be mixed or proportioned with 94 parts of water, while in the case of a 3% AFFF agent, 3 parts of agent have to be mixed with 97 parts of water and in the case of a 1% AFFF agent, 1 part of agent has to be mixed with 99 parts of water in order to obtain agent solutions providing upon aeration aqueous film forming foams. Therefore, a 3% agent is twice as concentrated as a 6% agent and a 1% agent is six times as concentrated as a 6% agent. Therefore, today's 6%, 3% and 1% agents contain 16 or 32 or 99 times higher fluorine contents or fluorochemical surfactant contents than quoted above for agent solutions or premixes.

Water soluble fluorochemical surfactants potentially useful in AFFF and AR-AFFF agents can be of the anionic, cationic, amphoteric or nonionic type. Most important in today's commercial agents are amphoteric fluorochemical surfactants, being compatible with any type of hydrocarbon surfactant, followed by anionic fluorochemical surfactants and nonionic fluorochemical surfactants.

Representative water-soluble amphoteric and anionic fluorochemical surfactants are listed in U.S. Pat. No. 5,085,786, while nonionic fluorochemical surfactants are disclosed in U.S. Pat. No. 5,218,021.

A major effort in the past has been the development of agents which could provide better fire fighting foam performance such as quicker fire control and extinguishment, longer foam life and burnback resistance. Today, in addition to developing AFFF and AR-AFFF agents with improved fire performance it has become more and more important that agents are being developed which generate waste streams which either per se have less of a negative impact on the environment and especially on the aquatic ecosystem and the development of agents which produce waste streams which can readily be treated prior to release into public waste water treatment plants or into the environment, therefore having a reduced negative impact on the environment. This is especially important for agents used at fire fighting test facilities where agent waste streams can readily be collected and treated.

DETAILED DISCLOSURE

The present invention pertains to novel synergistic surfactant compositions based on water insoluble amphoteric fluorochemical surfactants of the betaine and sulfobetaine type (Component A) and water soluble anionic hydrocarbon or fluorochemical surfactants of the sulfate or sulfonate type (Component B) providing very low surface tension at very low concentrations. The present invention furthermore pertains to AFFF and AR-AFFF agents, said agents comprising the instant synergistic surfactant composition of Component A and Component B, amphoteric and nonionic hydrocarbon surfactants as Component C, water soluble solvents as Component D, fluorochemical synergists as Component E, polymeric film formers as Component F, polymeric foam stabilizers as Component G, electrolytes as Component H and water as Component I and said agents upon proportioning with water and aeration forming a highly efficient aqueous film forming foam for extinguishing non-polar and polar solvent and fuel fires or preventing such fires or the re-ignition of fires by suppressing the vaporization of volatile, flammable solvents and fuels. The present invention furthermore pertains to a method of treating aqueous solutions of the instant AFFF and AR-AFFF agents with cationic polyelectrolytes allowing the removal of Components A and B and other surfactants prior to the discharge of aqueous AFFF and AR-AFFF waste streams into waste water treatment plants or into the environment. Each of the Components A to H may consist of a specific compound or a mixture of compounds.

The instant AFFF agents are preferred to fight fires of flammable non-polar solvents and fuels such as gasoline, heptane, toluene, hexane, Avgas, and the like and polar solvents of low water solubility such as butyl acetate, methyl isobutyl ketone, ethyl acetate and the like, while the instant AR-AFFF agents are preferred to fight any type of flammable solvents and fuels, including polar solvents of high water solubility such as methanol, isopropanol, acetone, methyl ethyl ketone and the like.

The instant AFFF and AR-AFFF agents can be formulated having different strengths so that they can be used as so-called 1, 3 or 6% agents, indicating that a 1% agent has to be proportioned with 99 parts of fresh or sea water, while 3% and 6% agents require 97 and 94 parts of water respectively for proportioning.

Component A of the instant synergistic surfactant compositions are water insoluble amphoteric fluorochemical betaines and sulfobetaines represented by formula (I), $$R_f—L_1—N^+(R_1)(R_2)—(CH_2)_m—Q^- \quad (I)$$

wherein $R_f$ is a straight or branched chain perfluoroalkyl group with 5 to 18 carbon atoms and preferably 5 to 13 carbon atoms;

$L_1$ is a bivalent linking group with 1 to 4 carbon atoms and preferably $—CHF—(CH_2)_2—$ and $—(CH_2)_3—$, $R_1$ and $R_2$ are alkyl or hydroxyalkyl with 1 to 4 carbon atoms or hydrogen with the proviso that only one of the $R_1$ or $R_2$ substituents can be hydrogen and the preferred $R_1$ and $R_2$ groups being methyl;

$Q^-$ is $—COO^-$ or $—SO_3^-$ and m is 1 to 4 and preferably 1 if $Q^-$ is $—COO^-$ and preferably 3 if $Q^-$ is $—SO_3^-$.

Fluorochemical betaines and sulfobetaines of formula I are described in the patent literature. U.S. Pat. No. 4,183,367 discloses betaines of formula $$R_f—(CH_2)_{1\ to\ 4}—N^+(R_1)(R)_2—(CH_2)_{1\ or\ 2}—COO^-$$

In U.S. patent application Ser. No. 08/208,004, filed Mar. 9, 1994, fluorochemical betaines and sulfobetaines of formula I are described, having the formula $$R_f—CHF—(CH_2)_2—N^+(R_1)(R_2)—(CH_2)_m—COO^- \text{ and}$$

$$R_f—CHF—(CH_2)_2N^+(R_1)(R_2)—(CH_2)_m—SO_3^-$$

as well as compositions of the above betaines and betaines having the formula $$R_f—(CH_2)_3—N^+(R_1)(R_2)—(CH_2)_m—COO^- \text{ and}$$

compositions of the above sulfobetaines and sulfobetaines having the formula $$R_f—(CH_2)_3—N^+(R_1)(R_2)—(CH_2)_m—SO_3^-$$

wherein n is 3 to 17, and $R_1$ and $R_2$ are as previously described and m is 1, 2, 3 or4.

J. B. Nivet et al, *Journal Dispersion Science and Technology,* 13(6), 627,646 (1992), describe fluorobetaines of formula I having the structure $$R_f—(CH_2)_n—N^+(CH_3)_2—(CH_2)_m—COO^-,$$

wherein $R_f$ is $C_4H_9$, $C_6F_3$ and $C_8F_{17}$; n is 2 or 3 and m is 1, 3, 4 or 5.

Fluorochemical betaines and sulfobetaines of formula I are readily derived in very high yield from the corresponding precursor tertiary amines of formula $R_f—L_1—N(R_1)(R_2)$. Fluorochemical betaines of formula I are obtained by the carboxylation of the above tertiary amines with halogen carboxylic acids of the formula $X—(CH_2)_n—COOH$, wherein X is a halogen, preferably Cl or Br, or a salt or lower alkyl ester of said halogen carboxylic acids. Fluorochemical sulfobetaines of formula I are obtained via sulfalkylation of tertiary amines and a sultone having the formula

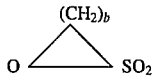

and preferably propane sultone or butane sultone as described in U.S. patent application Ser. No. 08/208,004.

While the synthesis of betaines and sulfobetaines from the precursor fluorochemical tertiary amines are high yield reactions, the synthesis of most of the fluorochemical tertiary amines of formula $R_f—L_1—N(R_1)(R_2)$ is complex and economically not attractive.

J. B. Nivet et al, *Eur. J. Med. Chem.,* (1992)27, 891–898 describe the synthesis of tertiary fluoroalkyl amines via the reduction of perfluoroalkyl-N, N-dialkylamides derived from perfluoroalkyl carboxylic acids or alternatively via hydrogenation of 1-azido -2-perfluoroalkyl ethanes.

Only moderate yields of 35 to 60% are reported for amines of the type $R_f—(CH_2)_2—N(CH_3)_2$ obtained from $R_f—(CH_2)_2—N_3$, while yields of amines $R_f—(CH_2)_n—N(R_1)(R_2)$ derived from $R_f$-acids of type $R_f—(CH_2)_nCOOH$, which are not simple starting materials, are quoted to be in the 55 to 85% range.

In U.S. patent application Ser. No. 08/208,004 of Mar. 9, 1994, the high yield synthesis of tertiary perfluoroalkyl amines of the type $R_fCHF—CH_2CH_2N(R_1)(R_2)$ and mixtures of these amines and $R_f—(CH_2)_3—N(R_1)(R_2)$ is described, yielding the preferred fluorochemical betaines and sulfobetaines of type I for use as Component A in the synergistic surfactant compositions of this invention.

Typical fluorochemical betaines and sulfobetaines of formula I are:

$C_6F_{13}—CH_2—N^+(CH_3)_2—CH_2COO^-$ $C_8F_{17}—CH_2—N^+(CH_3)_2—CH_2COO^-$ $C_5F_{11}—CHF—(CH_2)_2—N^+(CH_3)_2—CH_2COO^-$ $R_f—CHF—(CH_2)_2—N^+(CH_3)_2—CH_2COO^-$ and $R_f—(CH_2)_3—N^{+(CH}{}_3)_2—CH_2COO^-$ wherein $R_f$ is a mixture of $C_5F_{11}$, $C_7F_{15}$, $C_9F_{19}$ and $C_{11}F_{23}$ $C_{10}F_{21}—(CH_2)_4—N^+(CH_3)_2—CH_2COO^-$ $C_8F_{17}—(CH_2)_2—N^+(C_2H_5)_2—(CH_2)_2COO^-$ $C_6F_{13}—(CH_2)_2—N^+(CH_3)_2—(CH_2)_3SO_3^-$ $C_5F_{11}—(CH_2)_3—N^+(CH_3)_2—(CH_2)_3SO_3^-$ $C_5F_{11}—CHF—(CH_2)_2—N^+(CH_3)_2—(CH_2)_3SO_3^-$ $C_7F_{15}—CHF—(CH_2)_2—N^+(CH_3)_2—(CH_2)_4SO_3^-$ $R_f—CHF—(CH_2)_2—N^+(CH_3)_2—(CH_2)_3SO_3^-$ and $R_F—(CH_2)_3—N^+(CH_3)_2—(CH_3)_2SO_3^-$, wherein $R_f$ is a mixture of $C_5F_{11}$, $C_7F_{15}$, $C_9F_{19}$ and $C_{11}F_{23}$.

In contrast to water soluble fluorochemical betaines and sulfobetaines as listed in U.S. Pat. No. 5,085,786 providing surface tensions as low as 15 to 18 dynes/cm in water at room temperature, as required to yield efficient AFFF and AR-AFFF agents, fluorochemical betaines and sulfobetaines of formula I are either not soluble enough per se in water at room temperature to be useful in AFFF agents or if soluble enough at room temperature provide minimum surface tensions of only 18 dynes/cm and above. The instant preferred fluorochemical betaines and sulfobetaines of formula I have solubilities in water at room temperature of less than 0.01 percent and some of the most preferred betaines and sulfobetaines of formula I were found to have solubilities in their pure state of only 0.002 to 0.003 percent by weight in water at room temperature. The instant fluorochemical betaines and sulfobetaines having individually solubilities of less than 0.01 percent in water at room temperature are referred to as water insoluble surfactants.

Betaines and sulfobetaines of formula I wherein the linking group $L_1$ is $—CHF—(CH_2)_2—$ and $—(CH_2)_3—$, having solubilities below 0.01% are described in U.S. patent application Ser. No. 08/208,004. These insoluble betaines and sulfobetaines, when solubilized in water at elevated temperatures do, however, exhibit exceptionally low surface tensions and values as low as 14.2 dynes/cm were observed at temperatures of 80° C.

Betaines of formula I having the formula $$C_8F_{17}—(CH_2)_3—N^+(CH_3)_2—(CH_2)_m—COO^-,$$

wherein m is 3, 4 and 5 were found by J. B. Nevit et al, *J. Dispersion Science and Technology,* 13(6), 627–646 (1992) still to be water soluble at room termperature, but provided minimum surface tensions of only 25.7 dynes/cm (m=3), 27.6 dynes/cm (m=4) and 27.0 dynes/cm (m=5). Nivet et al. also found that a betaine having the formula $C_6F_{13}(CH_2)_2—N^+(CH_3)_2—CH_2—COO^-$ was also still soluble in water, giving a minimum surface tension of 21.5 dynes/cm, while the analogues betaine of formula $C_8F_{17}(CH_2)_2—N^+(CH_3)_2—CH_2COO^-$ as already found to be so sparingly soluble which did preclude determination of physicochemical data.

Surface tensions, as shown in the experimental part, of the water insoluble betaines and sulfobetaines of type I can be determined at elevated temperatures or in certain instances at room temperature by heating the surfactant solutions and upon cooling determine the surface tensions when the temperature reaches 20° C. and before precipitation occurs, which can happen within minutes of reaching room temperature.

It was unexpectedly found that compositions of betaines and sulfobetaines (Component A) and water soluble anionic hydrocarbon and fluorochemical surfactants of the sulfate and sulfonate type (Component B) had not only increased solubility in water, but did provide minimum surface tensions which were lower than could be obtained with either Component A or Component B alone.

Water soluble sulfate or sulfonate surfactants have the general formula II $$R—L_2—Q_2 \qquad \text{(II)}$$

wherein

R is either $R_f$ or $R_h$ and $R_f$ is a straight or branched chain perfluoroalkyl group with 3 to 18 carbon atoms and preferably 6 to 12 carbon atoms, $R_h$ is a straight or branched alkyl, alkenyl, cycloalkanyl or cycloparaffin group with 6 to 18 carbon atoms and preferably an alkyl group with 8 to 12 carbon atoms and $L_2$ is either zero or a bivalent linking group and $Q_2$ is either $—SO_3M$ or $—OSO_3M$ and preferably $—OSO_3M$ if R is $R_h$ and $—SO_3M$ if R is $R_f$, M is typically hydrogen, sodium, potassium, but can be any other counterion such as lithium, calcium, magnesium or an ammonium ion $N(R_3)_4$, where each $R_3$ may be independently selected from the group consisting of hydrogen, alkyl, hydroxyalkyl, aryl, aralkyl or alkaryl group.

Water soluble sulfates and sulfonates of formula II having a variety of linking groups $L_2$ are well known and commercially available. Illustrative examples of hydrocarbon sulfates are alkyl and alkyl ether sulfates such as $C_8H_{17}OSO_3Na$ $C_{10}H_{21}OSO_3Na$ $C_{12}H_{25}OSO_3Na$ $C_{10}H_{21}(OCH_2CH_2)_{1\ to\ 3}OSO_3Na$ $C_{12}H_{25}(OCH_2CH_2)_{1\ to\ 3}OSO_3Na$ $C_{12}H_{25}—C_6H_4—(OCH_2CH_2)_4OSO_3Na$ Illustrative examples of hydrocarbon sulfonates are linear alkyl benzene, toluene, and xylene sulfonates; petroleum sulfonates; N-acyl-n-alkyltaurates; paraffin and secondary n-alkane sulfonates; alpha-olefin sulfonates; sulfosuccinate esters; alkyl naphthalene sulfonates and sulfonates such as $C_{11}H_{23}CON(CH_3)CH_2CH_2SO_3Na$ $C_{11}H_{23}OCOCH_2CH(SO_3Na)COONa$ $CH_3(CH_2CH_2)_{4-6}COOCH_2CH_2SO_3Na$ $CH_3(CH_2CH_2)_{4-6}CON(CH_3)CH_2CH_2SO_3Na$ $CH_3(CH_2CH_2)_5CH_2CONHCH_2CH_2OCOCH_2CH(SO_3Na)COONa$ $NaO_3S—C_{10}H_6—CH_2—C_{10}H_6—(SO_3Na)CH_2—C_{10}H_6—SO_3Na$ Illustrative fluorochemical sulfates and sulfonates useful as Components B are:

$C_8F_{17}OSO_3Na$ $C_8F_{17}SO_3K$ $C_8F_{17}SO_3NHCH_2C_6H_4SO_3Na$ $C_8F_{17}SO_3NHC_6H_4SO_3H$ $C_8F_{17}C_2H_4SC_2H_4CONHC(CH_3)_2CH_2SO_3Na$ $C_{10}F_{19}OC_6H_4SO_3Na$ $(CH_3)_2CF(CF_2)_4CONHC_2H_4SO_3Na$ $C_{10}F_{21}SO_3NH_4$

It is known that anionic sulfate and sulfonate surfactants form in aqueous solution a weak complex with the cationic site of amphoteric surfactants and it is therefore assumed that Components A form such weak complexes with Components B and that such weak complexes have not only increased solubility in water, but have also lower surface tensions than either of the components alone.

It was also found that it is not necessary that equimolar amounts of Component A and B have to be employed to obtain increased solubility and decreased surface tension values. Based on experimental results, it can be shown that less than equimolar amounts of Components B will solubilize Components A indicating that a complex formed from Component A and B will solubilize excess amounts of non-complexed Component A. On the other hand, an excess of the water soluble Component B can also be employed especially if excess amounts of Component B will contribute to the foam quality of AFFF and AR-AFFF agents derived from the synergistic compositions of this invention. Therefore, the instant synergistic compositions can be composed of from 5 to 95 percent of Component A and of from 95 to 5 percent of Component B, but preferably the ratio of Component A and B is chosen in such a way that Component B is present in either an equimolar amount and preferably in excess of equimolar amounts.

Synergistic surfactant compositions based on Component A and Component B do provide aqueous solutions with low surface tensions at very low surfactant levels and are, therefore, useful in many fields of applications. The use of low surface tension aqueous solutions is well known and described in detail in U.S. Pat. No. 4,098,804 and includes applications by many industries.

Most important, however, is the use of low surface tension aqueous solutions in the field of aqueous film forming foams used for fighting polar and non-polar solvent and fuel fires as previously described.

The AFFF and AR-AFFF agents of this invention, based on the instant novel synergistic surfactant compositions and useful for 6, 3 and 1% as well as other proportioning systems comprise the following components, numbered A through I.

A. 0.5 to 10% by weight of fluorochemical betaines and sulfobetaines of formula $R_f—L_1—N^+(R_1)(R_2)—(CH_2)_m—Q^-$;

B. 1 to 40% by weight of hydrocarbon or fluorochemical anionic sulfates or sulfonates of the formula $R—L_2—Q_2$;

C. 0 to 40% by weight of amphoteric and non-ionic hydrocarbon surfactant;

D. 0 to 70% by weight of a water miscible solvent;

E. 0 to 3% by weight of fluorochemical synergist;

F. 0 to 3% by weight of a water soluble polymeric film former;

G. 0 to 10% by weight of a polymeric foam stabilizer;

H: 0 to 5% by weight of an electrolyte;

I: Water in an amount to make up the balance of 100%.

Preferred Components A are betaines and sulfobetaines of formula $R_f—CHF—CH_2CH_2—N^+(CH_3)_2—CH_2COO^-$ and $R_f—CHF—CH_2CH_2—N^+(CH_3)_2—CH_2SO^-$ and more preferred are betaine blends and sulfobetaine blends of the type $R_f—CHF—CH_2CH_2—N^+(CH_3)_2—CH_2COO^-$ (80%)

$R_f—(CH_2)_3—N^+(CH_3)_2—CH_2COO^-$ (20%)

and $R_f—CHF—CH_2CH_2—N^+(CH_3)_2—(CH_2)_3SO_3^-$ (80%)

$R_f—(CH_2)_3—N^+(CH_3)_2—CH_2SO_3^-$ (20% )

wherein $R_f$ is a blend of $C_5F_{11}$, $C_7F_{15}$, $C_9F_{19}$ and $C_{11}F_{23}$. Most preferred are blends of the above 80/20 blends of betaines and sulfobetaines because such blends of blends have increased solubility in water as well as increased efficiency of reducing surface tension to very low levels at very low concentration if used in combination with Component B.

Components B were described before and preferred Components B are hydrocarbon sulfates such as alkyl sulfates, wherein alkyl is octyl, decyl and undecyl and alkyl ether sulfates wherein alkyl is decyl and undecyl.

Components C are hydrocarbon surfactants broadly chosen from amphoteric and nonionic surfactants as represented in the tabulations combined in Rosen et al, *Systematic Analysis of Surface Active Agents,* Wiley-Interscience, New York (2nd edition, 1982), pp. 485–544, which is incorporated herein by reference.

Amphoteric surfactants are described as a distinct chemical category containing both anionic and cationic groups and exhibiting special behavior dependent on their isoelectric pH range, and their degree of charge separation.

Preferred amphoteric hydrocarbon surfactants are chosen with regard to their exhibiting an interfacial tension below 5 dynes/cm at concentrations of 0.01–0.3% by weight, exhibiting high foam expansions at their use concentration, and improving seal persistence. They must be thermally stable at practically useful application and storage temperatures, be acid and alkali resistance, be readily biodegradable and nontoxic, especially to aquatic life, be readily dispersible in water, be unaffected by hard water or sea water, be tolerant of pH, and be readily available and inexpensive.

Preferred amphoteric hydrocarbon surfactants include compounds which contain in the same molecule the following groups: amino and carboxy, amino and sulfuric ester, amino and alkane sulfonic acid, amino and aromatic sulfonic acid, miscellaneous combinations of basic and acidic groups, and the special case of aminimides.

Most preferred amphoterics are those which contain amino and carboxy or sulfo groups.

Illustrative examples of hydrocarbon amphoteric surfactants are:

coco fatty betaine cocoylamidoethyl hydroxethyl carboxymethyl glycine betaine cocoylamidoammonium sulfonic acid betaine cetyl betaine (C-type)

$C_{11}H_{23}CONN(CH_3)_2CHOHCH_3$

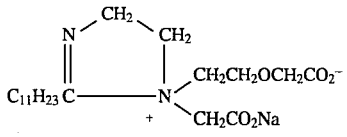

A coco-derivative of the above

Coco Betaine $C_{12\text{-}14}H_{25\text{-}29}{}^{+NH}{}_2CH_2CH_2COO^-$

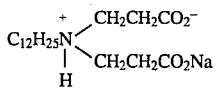

Nonionic hydrocarbon surfactants are used as Components C primarily as agent stabilizer and solubilizer to achieve hard water or sea water stability of agent premixes. The nonionics are chosen on the basis of their hydrolytic and chemical stability, solubilization and emulsification characteristics (e.g. measured by HLB-hydrophilic-lipophilic balance), cloud point in high salt concentrations, toxicity, and biodegradation behavior. Secondarily, they are chosen with regard to foam expansion, foam viscosity, foam drainage, surface tension, interfacial tension and wetting characteristics.

Typical classes of nonionic surfactants useful in this invention include polyoxethylene derivatives of alkylphenols, linear or branched alcohols, fatty acids, alkylamines, alkylamides, and acetylenic glycols. Other nonionics are alkyl glycosides and polyglycosides, and nonionics derived from block copolymers containing polyoxyethylene and polyoxypropylene units.

Preferred are polyoxyethylene derivatives of alkylphenols, linear or branched alcohols, alkyl glucosides and polyglucosides and block polymers of polyoxyethylene and polyoxypropylene.

Illustrative examples of the nonionic hydrocarbon surfactants are

Octylphenol $(EO)_{9,10}$

Octylphenol $(EO)_{16}$

Octylphenol $(EO)_{30}$

Nonylphenol $(EO)_{9,10}$

Nonylphenol $(EO)_{12,13}$

Lauryl ether $(EO)_{23}$

Stearyl ether $(EO)_{10,12}$

Sorbitan monolaurate $(EO)_{20}$

Dodecylmercaptan $(EO)_{10}$ $C_{11}H_{23}CON(C_2H_4OH)_2$ $C_{12}H_{25}N(CH_3)_2$ O EO used in the above formulas means ethylene oxide repeating unit.

Components D are water soluble solvents which act as solubilizer, foaming aid and foam stabilizer as well as anti-freeze or as a refractive index modifier, so that proportioning systems can be field calibrated. Useful solvents are disclosed in U.S. Pat. Nos. 3,457,172; 3,422,011 and 3,579,446.

Typical solvents are alcohols or ethers such as: ethylene glycol monoalkyl ethers, diethylene glycol monoalkyl ethers, propylene glycol monoalkyl ethers, dipropylene glycol monoalkyl ethers, triethylene glycol monoalkyl ethers, 1-butyoxyethoxy-2-propanol, glycerine, diethyl carbitol, hexylene glycol and ethylene glycol.

Preferred solvents are diethyleneglycol and monobutyl ethers, propylene glycol and ethylene glycol.

Components E are optional components which include so-called fluorochemical synergists such as fluorochemicals of the type $(R_f)_nT_mZ$ and $R_f{\bullet}R_f$ or $R_f{\bullet}R_h$-ion pair complexes which increase the efficiency of fluorochemical surfactants, allowing the formulation of AFFF agents having either improved performance or the same performance at lower total fluorine levels.

Fluorochemical synergists of the type $(R_f)_nT_mZ$ useful as optional Component E are described in U.S. Pat. No. 4,089,804 and illustrative examples include:

$C_8F_{17}SO_2NH_2$ $C_8F_{17}SO_2N(C_2H_5)CH_2CHOHCH_2OH$ $C_8F_{17}SO_2N(CH_3)CH_2CHOHCH_2OH$ $C_8F_{17}SO_2N(CH_2CH_2OH)_2$ $C_8F_{17}SO_2N(CH_2CH_2SH)_2$ $C_6F_{13}CH_2CH_2SCH_2CH_2CONHCH_2OH$ $C_8F_{17}SO_2N(CH_3)CH_{10}H_{20}CH_2OH$ $C_7F_{15}CON(C_2H_5)CH_2CH_2OH$ $CF_3C_6F_{10}SO_2N(C_2H_5)CH_2CH_2OH$ $C_3F_7O(C_3F_6O)_2CH_2CON(CH_3)C_3H_6OH$ $C_8F_{17}SO_2N(C_4H_9)CH_2CHOHCH_2OH$

Ion-pair complexes useful as optional Components E are derived from anionic and cationic fluorochemical surfactants and/or hydrocarbon surfactants. Such ion-pair complexes of the $R_f{\bullet}R_f$ or $R_f{\bullet}R_h$-type, if properly prepared form so-called liquid crystals and can be dispersed in AFFF agents. Such ion-pair complexes are described in U.S. Pat. Nos. 3,661,776; and 4,420,434 and Japanese Disclosures Nos. 3428/80 and 45459/80 and are herein incorporated by reference. Ion-pair complexes can be made by reacting equi-molar amounts of anionic and cationic surfactants in such a way as described in U.S. Pat. No. 4,472,286 that stable dispersions are obtained.

A preferred example of a $R_f{\bullet}R_f$ ion-pair complex is:

$R_fCH_2CH_2SCH_2CH_2CONHC(CH_3)_2CH_2SO_3{\bullet}N(CH_3)_3CH_2$ $CHCHCH_2SCH_2CH_{Rf}$ while a typical example of an $R_h{\bullet}R_f$ ion-pair comples is $C_{10}H_{21}OSO_3{\bullet}N(CH_3)_3$ $CH_2CHOHCH_2SCH_2R_f$ Preferred ion-pair complexes for AFFF agent of this invention are $R_h{\bullet}R_f$ and $R_f{\bullet}R_f$ ion-pair complexes derived from sulfate and sulfonate hydrocarbon and fluorochemical surfactants as described as Component B and cationic fluorochemical surfactants as described in U.S. Pat. No. 4,089,804. Illustrative examples of cationic fluorochemical surfactants useful for ion-pair complex formation with sulfate and sulfonate anionic surfactants (Component B) are:

$R_fCH_2CH_2SCH_2CHOHCH_2N^+(CH_3)_3$ $C_8F_{17}SO_2NHC_3H_6N^+(CH_3)_3Cl^-$ $C_8F_{17}SO_2NHC_3H_6N^+(CH_3)_2C_2H_5^-OSO_2OC_2H_5$
$C_8F_{17}SO_2NHC_3H_6N^+(CH_3)_3I^-$
$C_7F_{15}CONHC_3H_6N^+(CH_3)_3Cl^-$
$C_7F_{15}CONHC_3H_6N^+(CH_3)_3CH_2C_6H_5Cl^-$
$C_8F_{17}SO_2N(CH_3)C_3H_6N^+(CH_3)_3I^-$

Components F are water soluble polymeric film formers and are essential for the formulation of so-called AR-AFFF (alcohol resistant) agents which are used to fight both polar (water soluble) and non-polar solvent and fuel fires. These polymeric film formers, dissolved in AR-AFFF agents, will precipitate from solution when getting in contact with polar solvents and fuel and will form a polymer film at the solvent/foam interface, preventing a collapse of the foam.

Most preferred Components F are thixotropic polysaccharide gums as described in U.S. Pat. Nos. 3,957,657; 4,060,132; 4,060,489; 4,306,979; 4,387,032; 4,420,434; 4,424,133; 4,464,267 and 5,218,021. Trade names of such gums are RHODOPOL, KELCO, KELTROL, ACTIGUM, CECAL-GUM, CALAXY AND KALZAN.

Gums and resins useful for the purposes of this invention include acidic gums such as xanthan gum, pectic acid, alginic acid, agar, carrageenan gum, rhamsam gum, welan gum, mannan gum, locust beam gum, galactomannan gum, pectin, starch, bacterial alginic acid, succinoglucan, gum arabic, carboxymethylcellulose, heparin, phosphoric acid polysaccharide gums, dextran sulfate, dermantan sulfate, fucan sulfate, gum karaya, gum tragacanth and sulfated locust bean gum.

Neutral polysaccharides useful as Components F include: cellulose, hydroxyethyl cellulose, dextran and modified dextrans, neutral glucans hydroxypropyl cellulose as well as other cellulose ethers and esters. Starches and modified starches have also proven to be useful additives. Modified starches include starch esters, ethers, oxidized starches, and enzymatically digested starches.

Components G are polymeric foam stabilizers and thickeners which can optionally be incorporated into AFFF and AR-AFFF agents to enhance the foam stability and foam drainage properties. Examples of polymeric stabilizers and thickeners are partially hydrolyzed protein, starches, polyvinyl resins such as polyvinyl alcohol, polyacrylamides, carboxyvinyl polymers and poly(oxyethyane) glycol.

Components H are electrolytes, added to AFFF and AR-AFFF agents to balance the performance of such agents when proportioned with water ranging from very soft to very hard to sea water and to improve agent performance in very soft water. Typical electrolytes are salts of monovalent or polyvalent metals of Groups 1, 2 or 3, or organic bases. The alkali metals particularly useful are sodium, potassium, and lithium, or the alkaline earth metals, especially magnesium, calcium, strontium, and zinc or aluminum. Organic bases might include ammonium, trialkylammonium, bis-ammonium salts or the like. The cations of the electrolyte are not critical, except that halides are not desireable from the standpoint of metal corrosion. Sulfates, bisulfates, phosphates, nitrates and the like are acceptable.

Preferred are polyvalent salts such as magnesium sulfate, magnesium nitrate or strontium nitrate.

Still other components which may be present in the instant AFFF and AR-AFFF agents are:

Buffers whose nature is essentially non-restricted and which are exemplified by Sorensen's phosphate or McIlvaine's citrate buffers.

Corrosion inhibitors whose nature is non-restricted so long as they are compatible with the other formulation ingredients. They may be exemplified by ortho-phenylphenol or toluyl triazole.

Chelating agents whose nature is non-restricted, and which are exemplified by polyaminopolycarboxylic acids, ethylenediaminetetraacetic acid, citric acid, tartaric acid, nitrilotriacetic acid, hydroxyethylethylenediaminetriacetic acid and salts thereof.

It is also understood that the novel synergistic surfactant compositions based on Component A and Component B can be used as additives to AFFF and AR-AFFF compositions based on other fluorochemical surfactants, including AFFF agents as summarized in U.S. Pat. Nos. 4,999,119; 4,420,434; 4,472,286; 5,085,786 and 5,218,021 and AR-AFFF agents as described in U.S. Pat. Nos. 4,060,49; 4,149,599; 4,387,032 and 4,999,119.

It is further understood that fluorochemical surfactants disclosed as components in the previously referenced AFFF and AR-AFFF agents can be used as additives to AFFF and AR-AFFF agents of this invention in order to achieve desired performance properties, such as equal or similar performance in fresh and sea water, an optimum balance between extinguishment and burnback resistance and other properties as specified in the many different agent specifications.

The use of AFFF and AR-AFFF agents, especially at fire fighting training facilities, generates a waste stream containing agent and fuel, as well as agent and fuel decomposition products. While treatment of such waste streams in oil/water separators will remove most of the fuel, the remaining aqueous waste stream, if released directly into waste water treatment plants, will not only generate a foam problem, but can also kill bacteria and other aquatic life forms. While biodegradable hydrocarbon surfactants can be used in AFFF and AR-AFFF agents which will be biodegraded in waste water treatment plants, fluorochemical surfactants are only partially biodegradable because the perfluoroalkyl group present in all fluorochemical surfactants is resistant to biodegradation. Methods to remove ionic fluorochemical surfactants from aqueous waste streams are described in the literature by D. Prescher et al, *Acta Hydrochim. Hydrobiol.* 14 (1986) 3, 293–304 and by H F. Schroeder, *Vom Wasser,* 77 (1991) 277–290 and include methods such as flocculation, adsorption, ion exchange and reverse osmosis, methods found in many instances not to be very efficient and too costly. Because the instant AFFF and AR-AFFF agents are based on water insoluble betaines and/or sulfobetaines (Component A) which are solubilized by water soluble anionic sulfate and sulfonate surfactants (Component B), a method was found to remove both Components A and B near quantitatively from aqueous waste streams. This method is based on destroying the complex between Component A and Component B by precipitating Component B with cationic polyelectrolytes, leading not only to the precipitation of Component B but also to the precipitation of the amphoteric fluorochemical surfactant (Component A), which is water insoluble if not solubilized by Component B. It is therefore possible with limited quantities of cationic polyelectrolytes to remove Components A and B from the aqueous waste stream by removing the precipitate using well-known methods such as filter pressing, centrifuging, lagooning and settlement or application of drying beds.

Useful cationic polyelectrolytes are commercially available and are described in Kirk-Othmer, *Concise Encyclopedia of Chemical Technology,* John Wiley and sons, New York, 492–493 (1985) and include poly(ethyleneamine); poly(2-hydroxypropyl-1-N-methylammoniumchloride); poly(2-hydroxypropyl-1,1-N-dimethylammonium chloride); poly[N-dimethylaminomethyl)-acrylamide]; poly(2-vinylimidazolinum bisulfate); poly(diallyldimethylammonium chloride); poly(N,N-dimethylaminoethylmeth acrylate), neutralized or quaternized; and poly[N-dimethylaminopropyl)-methacrylamide].

EXPERIMENTAL PART

The following examples are illustrative of various representative embodiments of the invention and are not to be interpreted as limiting in scope of the appended claims, In Examples 1 to 37, surface tension values are presented obtained with novel synergistic surfactant compositions. Examples 38 to 48 show the physical properties of aqueous film forming foam agents based on the novel synergistic surfactant compositions. Examples 49 to 56 show the performance of novel AFFF agents in tap and sea water, including MIL-F-24385F fire test results as a function of fluorine or fluorochemical surfactant content in the instant AFFF agents.

Example 57 shows the treatment of AFFF agent waste stream with a cationic polyelectrolyte and the removal of fluorochemical and hydrocarbon surfactants from such an agent waste stream.

In these examples, references are made to specifications used by the industry and the military to evaluate the efficiency of selected agents. More specifically, the examples refer to the following specifications and laboratory test methods:

1. Surface Tension and Interfacial Tension: According to ASTM D-1331-56.
2. Laboratory Film Spreading and Burnback Test: This test is carried out to determine film formation and film speed of AFFF premixes on cyclohexane as well as film life.

A 100×20 mm pyrex petri dish is placed over a dark, wet surface, so that good visual observation is possible. 50 ml of cyclohexane solvent is added to the petri dish. A 0.5 inch long stainles steel wood screw, pointing upwards, is placed in the center of the dish. The timer is started and simultaneously 3 ml of AFFF premix are added dropwise from a capillary pipette in one second intervals onto top of screw.

When the surface of the solvent is completely covered with the film, the time of seal is recorded. The timer is left running and the screw is removed carefully so as not to disturb the film layer. With a lighter, the surface is tested for breakup of the seal. If the seal is broken, the solvent will ignite. The flames are extinguished by placing a cardboard over the dish. The timer is stopped and the time of breakup is recorded.

3. Laboratory Foam Expansion and Drain Time Test: 100 ml of an AFFF premix to be tested is prepared with either tap or artificial seawater (ASTM D1141). 100 ml of AFFF premix is poured into a Waring blender. At medium speed, the AFFF solution is blended for 60 seconds. The generated foam is poured into a graduated 1000 ml cylinder, and a spatula is used to remove any residual foam in the blender cup. The foam height is recorded and the foam expansion rate is calculated by dividing foam volume (ml) by foam weight (g). The time which passes between the time the blender was stopped and the drain in the graduated cylinder reaches (a) 25.0 mi. and (b) 50 mi. is recorded. These times are called ¼ and ½ drain times.
4. 28 Square Foot Fire Test: The most critical tests carried out with permixes of the instant compositions are field fire tests, one of the most severe fire tests being a 28 sq. foot fire test as specified in the U.S. Department of Defense Specification MIL-F-24385F of Jan. 7, 1992.

Premixes of the compositions of this invention are prepared with tap or sea water as specified in the examples and subjected to the following fire test:

The 28-Square-Foot Fire Test was conducted in a level circular pan 6 feet (1.83 m) in diameter (28 square feet–2.60 square meters), fabricated from ¼" (0.635 cm) thick steel and having sides 5" (12.70 cm) high, resulting in a freeboard of approximately 2½" (6.35 cm) during tests. The water depth was held to a minimum, and used only to ensure complete coverage of the pan with fuel. The nozzle used for applying agent had a flow rate of 2.0 gallons per minute or 7.57 liter per minute at 100 pounds per square inch (7.03 kg/sq. cm) pressure. The outlet was modified by a "wing-tip" spreader having a ⅛" (3.175 mm) wide circular arc orifice 3⅞" (7.76 cm) long.

The premix solution in fresh water or sea water was kept at 70° +or– 10° F. (21° C. +or– 5.5° C.). The extinguishing agent consisted of an AFFF premix made with fresh or sea water and the fuel charge was 10 gallons (37.85 l) of gasoline. The complete fuel charge was dumped into the pan and the fuel was ignited within 60 seconds after completion of fueling and permitted to burn freely for 15 seconds before the application of the extinguishing agent. The fire was extinguished as rapidly as possible by maintaining the nozzle 3½ to 4 feet above the ground and angled upward at a distance that permitted the closest edge of the foam pattern to fall on the nearest edge of the fire. When the fire was extinguished, the time-for-extinguishment was recorded and application of the agent was continued over the test area until exactly 3 gallons (11.36 l) of premix had been applied (90-second application time).

The burnback test was started within 30 seconds after the 90-second foam application. A 1-foot (30.48 cm) diameter pan having 2" (5.08 cm) side walls and charged with 1 quart (0.946 l) of gasoline was placed in the center of the area. The fuel in the pan was ignited just prior to placement. Burnback time commenced at the time of this placement and was terminated when 25 percent of the fuel area (7 square feet–0.65 sq. meter), originally covered with foam was aflame. After the large test pan area sustained burning, the small pan was removed.

In addition to the extinguishment time and 25% burnback time as described above, the following performance criteria are also being determined in the 28 square foot fire test, namely (a) "Control Time," which is the time to bring the fire under control after the aqueous film forming foam has been applied, without having extinguished rim fires in the 28 square foot pan and (b) "Foam Expansion and Foam Drainage Time" which is determined with foam generated prior to the actual fire test with the same 2 g.p.m. nozzle as used for the fire test as specified in MIL-F-24385F, 4.7.5.

In Tables 1a to 1b, the compounds are listed used in the following examples for the formulation of the instant synergistic surfactant compositions and AFFF agents.

EXAMPLES 1 TO 10

Table 2 shows the surface tension values in dynes/cm obtained with Components A in distilled water at concentrations ranging from 0.1% to 0.01% solids determined at random temperatures ranging from room temperature or approximately 20° C. up to 80° C. Because individual betaines and sulfobetaine surfactants are so insoluble in water at room temperature, the surface tensions as shown in Examples 1 through 8 are either measured at elevated temperatures or are measured upon cooling to room temperature as super saturated solutions before precipitation at room temperature did occur which usually happened within minutes. Examples 1 through 8 show, that at temperatures in the 40° to 80° C. range, betaines and sulfobetaines of type I can provide surface tensions in the extremely low and most desirable range of 14 to 17 dynes/cm while at temperatures below 40° C. down to room temperature (prior to precipitation) surface tension values in the 18 to 25 dynes/cm are obtained. One exception being betaine A-5, having a $R_f$-group which is 100% $C_5F_{11}$ giving a high surface tension even at 80° C.

TABLE 1a

| Components A[1)] | Component Formulas | | $R_f$-Distribution, % | | | |
|---|---|---|---|---|---|---|
| | | | $C_5F_{11}$ | $C_7F_{15}$ | $C_9F_{19}$ | $C_{11}F_{23}$ |
| A-1 Betaine | $R_fCHF—(CH_2)_2—N^+(CH_3)_2—CH_2COO^-$ | | 24 | 59 | 16 | 1 |
| A-2 Sulfobetaine | $R_fCHF—(CH_2)_2—N^+(CH_3)_2—(CH_2)_3SO_3^-$ | | 24 | 59 | 16 | 1 |
| A-3 Betaine Blend | $R_fCHF—(CH_2)_2—N^+(CH_3)_2—CH_2COO^-$ | (80%) | 27 | 56 | 15 | 2 |
| | $R_f(CH_2)_3—N^+(CH_3)_2—CH_2COO^-$ | (20%) | 27 | 56 | 15 | 2 |
| A-4 Betaine Blend | As above. | (80%) | 4 | 59 | 36 | 1 |
| | As above. | (20%) | 4 | 59 | 36 | 1 |
| A-5 Betaine Blend | As above. | (80%) | 100 | — | — | — |
| | As above. | (20%) | 100 | — | — | — |
| A-6 Sulfobetaine Blend | $R_f—CHF—(CH_2)_2—N^+(CH_3)_2—(CH_2)_3SO_3^-$ | (80%) | 27 | 56 | 15 | 2 |
| | $R_f(CH_2)_3—N^+(CH_3)_2—(CH_2)_3SO_3^-$ | (20%) | 27 | 56 | 15 | 2 |
| A-7 Sulfobetaine Blend | As above. | (80%) | 4 | 59 | 36 | 1 |
| | As above. | (20%) | 4 | 59 | 36 | 1 |
| A-8 Sulfobetaine Blend | $R_f—CHF—(CH_2)_2—N^+(CH_3)_2—(CH_2)_4SO_3^-$ | (80%) | 27 | 56 | 15 | 2 |
| | $R_f(CH_2)_3—N^+(CH_3)_2—(CH_2)_4SO_3^-$ | (20%) | 27 | 56 | 15 | 2 |

[1)]The synthesis of the Components A is described in U.S. Pat. application Ser. No. 08/208/004, filed March 9, 1994.

TABLE 1b

| | | | |
|---|---|---|---|
| | | 1. Commercial Hydrocarbon Surfactants | |
| Standapol LF | (35%) | Henkel Corp. | $C_8H_{17}OSO_3Na/C_{10}H_{21}OSO_3Na$(70/30) |
| Standapol ES-1 | (25%) | " | $C_{12}H_{21}OCH_2CH_2OSO_3Na$ |
| Standapol ES-2 | (26%) | " | $C_{12}H_{25}(OCH_2CH_2)_2OSO_3Na$ |
| Standapol ES-3 | (28%) | " | $C_{12}H_{25}(OCH_2CH_2)_2OSO_3Na$ |
| Sulfotex 110 | (30%) | " | $C_{10}H_{21}OSO_3Na$ |
| Bioterge PAS-8S | (40%) | Stepan Co. | $C_8H_{17}OSO_3Na$ |
| Rhodapex CO-433 | (29%) | Rhone-Poulenc | $C_9H_{19}—C_6H_4—(OCH_2CH_2)_4OSO_3Na$ |
| Geropon WS-25 | (48%) | " | $C_{18}H_{37}—OCOCH_2CH(SO_3Na)COONa$ |
| Geropon TC-42 | (25%) | " | $CH_3(CH_2CH_2)_{4-6}COOCH_2CH_2SO_3Na$ |
| Geropon AS-200 | (66%) | " | $CH_3(CH_2CH_2)_{4-6}CON(CH_3)CH_2CH_2SO_3Na$ |
| Geropon SBFA-30 | (42%) | " | $CH_3(CH_2CH_2)_{4-6}CH_2(OCH_2CH_2)_3OCOCH_2CH(SO_3Na)COONa$ |
| Geropon SBL-203 | (40%) | " | $CH_3(CH_2CH_2)_5CH_2CONHCH_2CH_2OCOCH_2CH(SO_3Na)COONa$ |
| Rhodacal N | (86%) | " | $NaO_3S—C_{10}H_6—CH_2—C_{10}H_6(SO_3Na)CH_2C_{10}H_6SO_3Na$ |
| Glucopon 325 CS | (50%) | Henkel Corp. | $C_{9,10,11}$ Alkyl Polyglucoside |
| Lonzaine CS | (50%) | Lonza, Inc. | $Coco-CONH(CH_2)_3N^+(CH_3)_2CH_2COO^-$ |
| Deteric LP | (30%) | DeForest, Inc. | $C_{12}H_{25}N^+H(CH_2COOH/Na)CH_2COO^-$ |
| | | 2. Commercial Fluorochemical Surfactants | |
| Lodyne S-103A | (45%) | Ciba Corp. | $C_6F_{13}CH_2CH_2SCH_2CH_2CONHC(CH_3)_2CH_2SO_3Na$ |
| Lodyne S-106A | (30%) | Ciba Corp. | $C_6F_{13}CH_2CH_2SCH_2CH(OH)CH_2N^+(CH_3)_2Cl^-$ |
| Lodyne K78'220B | (40%) | Ciba Corp. | $C_8F_{17}CH_2CH_2S(CH_2CHCONH_2)_{15}H$ |
| Zonyl TBS | (33%) | DuPont | $R_fCH_2CH_2SO_3H$ |

TABLE 2

| | | Surface Tension ($Y_a$) in Distilled Water as a Function of Component A Solids and Temperature (°C.). | | | |
|---|---|---|---|---|---|
| | | 0.100% Solids | 0.050% Solids | 0.020% Solids | 0.010% Solids |
| Example | Compounds | $Y_a$ (°C.) | $Y_a$ (°C.) | $Y_a$ (°C.) | $Y_a$ (°C.) |
| 1 | A-1 | 14.2 (80)* | 14.0 (80)* | 13.7 (80)* | 15.1 (80)* |
| 2 | A-2 | 15.7 (60)* | 16.1 (60)* | 16.4 (60)* | 16.7 (RT)* |
| 3 | A-3 | 17.2 (43)* | 18.5 (34)* | 21.6 (37)* | 22.6 (RT)* |
| 4 | A-4 | 16.1 (50)* | 19.4 (33)* | 21.3 (35)* | 19.5 (RT)* |
| 5 | A-5 | 26.2 (80)* | 35.3 (80)* | 42.8 (80)* | 48.9 (80)* |
| 6 | A-6 | 20.4 (RT)* | 20.7 (RT)* | 21.8 (RT)* | 21.7 (RT)* |
| 7 | A-7 | 19.4 (RT)* | 20.4 (RT)* | 23.4 (RT)* | 25.4 (RT)* |
| 8 | A-8 | 19.7 (60)* | 19.0 (60)* | 21.1 (60)* | 23.8 (60)* |
| 9 | A-3/A-6 (50/50) | 17.9 (RT) | 19.0 (RT) | 18.5 (RT) | 19.8 (RT) |
| 10 | A-3/A-6 (50/50) | 17.1 (RT) | 18.7 (RT) | 18.4 (RT) | 18.3 (RT) |

The asterisk (*) indicates that component precipitated upon cooling below temperature indicated in brackets.
The asterisk after (RT)* indicates that upon cooling to RT, it was possible to measure the surface tension, but that precipitation occurred upon standing at room temperature.

Examples 9 and 10 show that using 50/50 blends of betaine and sulfobetaine surfactants, solutions are obtained, which are soluble at room temperature and which have surface tensions of 17 dynes/cm and above.

These data show that neither the fluorochemical betaines nor the sulfobetaines used alone are useful for applications at room temperature while blends of betaines and sulfobetaines are soluble in water at room temperature, but do not provide surface tensions in the most desirable 15 to 17 dynes/cm range obtained with other types of fluorochemical surfactants useful in AFFF agent formulations.

EXAMPLES 11 AND 12

Results in Table 3 show the synergistic effects achieved with compositions of betaine and sulfobetaine blends A-4/A-6 (Component A) and alkyl sulfates Standapol LF and Sulfotex 110 (Component B). While the blend A-4/A-6 gives a surface tension of 18.6 dynes/cm at 0.1% solids, compositions of A-4/A-6 and the alkyl sulfates provide surface tensions of 15.3 to 17.5 dynes/cm over a concentration range of 0.1 to 0.005% solids. Since alkyl sulfates, such as Standapol LF and Sulfotex 110 provide surface tensions of 38 and 34 dynes/cm at 0.05% solids in water, it is surprising to observe such a surface tension reduction.

EXAMPLES 13 TO 17

Table 4 shows surface tension values obtained with compositions of individual Component A, such as betaine A-3 and sulfobetaine A-6 as well as blends of A-3 and A-6 with variable amounts of Component B such as sodium lauryl sulfate, Bioterge PAS-8S and Sulfotex 110. These data show that small amounts of alkyl sulfate (Component B) not only reduces the surface tension values but also increases the solubility of Component A in water if Component B is present at levels as shown in Table 4. This synergistic effect of surface tension reduction can be observed at room temperature, where the effect is the largest and at 80° C., where the synergistic effect is less significant.

TABLE 3

| Component A (Blends) | % Solids in Solution | Component B | % Solids in Solution | Surface Tension Y at RT |
|---|---|---|---|---|
| Example 11 | | | | |
| A-4/A-6 (50/50) | 0.100 | None | — | 18.6 |
| A-4/A-6 (50/50) | 0.100 | Standapol LF | 0.100 | 15.3 |
| A-4/A-6 (50/50) | 0.020 | " | 0.020 | 15.7 |
| A-4/A-6 (50/50) | 0.010 | " | 0.010 | 16.2 |
| A-4/A-6 (50/50) | 0.005 | " | 0.005 | 17.5 |
| Example 12 | | | | |
| A-4/A-6 (50/50) | 0.100 | None | — | 18.6 |
| A-4/A-6 (50/50) | 0.100 | Sulfotex 110 | 0.100 | 15.8 |
| A-4/A-6 (50/50) | 0.020 | " | 0.020 | 15.8 |
| A-4/A-6 (50/50) | 0.010 | " | 0.010 | 15.8 |
| A-A/A-6 (50/50) | 0.005 | " | 0.005 | 16.4 |

TABLE 4

| Example | Component A | % Solids in Solution | Component B | % Solids in Solution | Surface Tension $Y_a$ at (°C.) |
|---|---|---|---|---|---|
| 13 | A-3 | 0.05 | None | — | 18.5 (34)* |
| | A-3 | 0.05 | Na-Lauryl Sulfate | 0.0125 | 15.7 (RT)* |
| | A-3 | 0.05 | " | 0.0250 | 15.7 (RT) |
| | A-3 | 0.05 | " | 0.0500 | 16.2 (RT) |
| | A-3 | 0.05 | " | 0.0750 | 16.4 (RT) |
| 14 | A-3 | 0.05 | None | — | 14.6 (80)* |
| | A-3 | 0.05 | Bioterge PAS-8S | 0.0125 | 13.7 (80)* |
| | A-3 | 0.05 | " | 0.0250 | 13.7 (80)* |
| | A-3 | 0.05 | " | 0.0500 | 12.9 (80)* |
| | A-3 | 0.05 | " | 0.1000 | 13.0 (80) |
| 15 | A-6 | 0.05 | None | — | 20.7 (RT)* |
| | A-6 | 0.05 | Bioterge PAS-8S | 0.0125 | 17.2 (RT)* |
| | A-6 | 0.05 | " | 0.0250 | 16.5 (RT)* |
| | A-6 | 0.05 | " | 0.0500 | 16.6 (RT) |
| | A-6 | 0.05 | " | 0.1000 | 16.7 (RT) |
| 16 | A-6 | 0.05 | None | — | 20.7 (RT)* |
| | A-6 | 0.05 | Sulfotex 110 | 0.0125 | 16.7 (RT) |
| | A-6 | 0.05 | " | 0.0250 | 16.7 (RT) |
| | A-6 | 0.05 | " | 0.0500 | 17.0 (RT) |
| 17 | A-3/A-6 (50/50) | 0.05 | None | — | 19.0 (RT) |
| | A-3/A-6 (50/50) | 0.05 | Sulfotex 110 | 0.0125 | 16.2 (RT) |
| | A-3/A-6 (50/50) | 0.05 | " | 0.0250 | 16.2 (RT) |
| | A-3/A-6 (50/50) | 0.05 | " | 0.0500 | 16.7 (RT) |
| | A-3/A-6 (50/50) | 0.05 | " | 0.0750 | 16.9 (RT) |
| | A-3/A-6 (50/50) | 0.05' | " | 0.1000 | 17.2 (RT) |

*See Comments Table 2.

EXAMPLES 18 TO 29

Table 5 shows the surface tension reduction which can be achieved with the addition of 0.025% solids of alkyl sulfates and sulfonates (Component B) to an aqueous solution containing 0.05% solids of betaine A-3. These data show that different Components B do provide different degrees of surface tension reduction, the most efficient ones being alkyl sulfates such as Standapol LF and Sulfotex 110.

TABLE 5

| Examples | Betaine 0.05% Solids | Alkyl Sulfates and Sulfonates 0.025% Solids | $Y_a$ at RT | Appearance of Solution |
|---|---|---|---|---|
| 18 | A-3 | None | 20.0 | Hazy |
| 19 | " | Standapol LF | 16.2 | Hazy |
| 20 | " | Sulfotex 110 | 15.6 | Clear |
| 21 | " | Standapol EA-1 | 17.4 | Clear |
| 22 | " | Standapol ES-2 | 17.9 | Clear |
| 23 | " | Standapol ES-3 | 17.6 | Clear |
| 24 | " | Rhodopex CO-433 | 17.1 | Hazy |
| 25 | " | Geropon WS-25 | 16.4 | Clear |
| 26 | " | Geropon TC-42 | 18.5 | Clear |
| 27 | " | Geropon SBFA-30 | 18.5 | Hazy |
| 28 | " | Geropon SBL-203 | 19.8 | Hazy |
| 29 | " | Rhodocal N | 19.2 | Hazy |

EXAMPLES 30 TO 35

Tables 6 and 7 show comparative surface tensions obtained with A-3 and A-1 betaines (Components A), with fluorochemical surfactants of the sulfonate type, LODYNE S-103 and Zonyl TBS (Components B) and with compositions of such Components A and B. The data in Tables 6 and 7 show that such compositions of Components A and B show lower surface tensions than either of the Component A or B alone and that solutions containing the Components A and B stay in solution upon cooling to room temperature indicating that Components B act as solubilizers of Components A.

EXAMPLES 36 AND 37

Table 8 shows that blends of betaines and sulfobetaines A-3/A-6 and A-4/A-7 have as previously shown high surface tension for fluorochemical surfactants, and also high interfacial tension (8.4 to 10.5 dynes/cm); show good foam expansion in laboratory foaming tests in both tap and sea water and show poor quarter drain times ranging from 12 to 80 seconds These data indicate that Components A will not act as defoamers and are therefore useful as components in AFFF agents, provided that surface tensions are reduced with Components B and interfacial tensions be reduced and drainage time increased with other components as shown in the following examples.

TABLE 8

| Properties of Betaine/Sulfobetaine Blends (50/50) at 0.01% Solids in Water | Example 36 A-3 Betaine/A-6 Sulfobetaine Blend | Example 37 A-4 Betaine/A-7 Sulfobetaine Blend |
|---|---|---|
| Surface Tension, $Y_a$ | 19.8 | 18.3 |
| Interfacial Tension, $Y_i$ | 10.5 | 8.4 |
| Foam Expansion Ratio, Tap | 4.6 | 4.2 |
| Foam Expansion Ratio, Sea | 4.9 | 4.5 |
| ¼ Drain Time, Tap, Seconds | 12.0 | 80.0 |
| ¼ Drain Time, Sea, Seconds | 57.0 | 41.0 |

TABLE 6

| Example 30 A-3 Betaine | | | Example 31 A-3 Betaine/ Lodyne S-103A Composition | | | Example 32 Lodyne S-103A | | |
|---|---|---|---|---|---|---|---|---|
| % Solids in Solution | Surface Tensions $Y_a$ at 80° C. | Surface Tensions $Y_a$ at 60° C. | % Solids in Solution | Surface Tensions $Y_a$ at 80° C. | Surface Tensions $Y_a$ at 60° C. | % Solids in Solution | Surface Tensions $Y_a$ at 80° C. | Surface Tensions $Y_a$ at 60° C. |
| 0.100 | 14.2* | 15.1* | 0.05/0.05 | 13.3 | 14.2 | 0.100 | 16.9 | 17.0 |
| 0.040 | 14.1* | 15.1* | 0.02/0.02 | 13.7 | 14.7 | 0.040 | 18.3 | 17.2 |
| 0.020 | 14.9* | 16.3* | 0.01/0.01 | 13.6 | 14.7 | 0.020 | 27.2 | 26.4 |
| 0.010 | 14.9* | 16.3* | 0.005/0.005 | 14.4 | 14.3 | 0.010 | 31.9 | 29.0 |
| 0.005 | 14.9* | 16.7* | 0.0025/0.0025 | 15.3 | 15.4 | 0.005 | 37.6 | 34.2 |

TABLE 7

| Example 33 A-1 Betaine | | | Example 34 A-3 Betaine/ Zonyl TBS[1)] Composition | | | Example 35 Zonyl TBS[1)] | | |
|---|---|---|---|---|---|---|---|---|
| % Solids in Solution | Surface Tensions $Y_a$ at 80° C. | Surface Tensions $Y_a$ at 60° C. | % Solids in Solution | Surface Tensions $Y_a$ at 80° C. | Surface Tensions $Y_a$ at 60° C. | % Solids in Solution | Surface Tensions $Y_a$ at 80° C. | Surface Tensions $Y_a$ at 60° C. |
| 0.100 | 14.2* | 15.1* | 0.05/0.025 | 12.5 | 13.6 | 0.100 | 23.6 | 26.3 |
| 0.040 | 14.3* | 15.1* | 0.02/0.010 | 12.7 | 13.3 | 0.040 | 24.6 | 30.5 |
| 0.020 | 14.2* | 16.3* | 0.01/0.005 | 13.0 | 14.2 | 0.020 | 24.0 | 28.3 |
| 0.010 | 15.1* | 16.3* | 0.005/0.0025 | 14.5 | 15.7 | 0.010 | 23.6 | 30.6 |

*See Comments Table 2

[1)]A stock solution (1% solids) of Zonyl TBS was prepared and adjusted to pH 7.4–7.8 with sodium hydroxide.

EXAMPLES 38 TO 43

The results in Table 9 show that solutions containing Component A (betaine/sulfobetaine blend A-4/A-6), Component B (alkyl sulfates Standapol LF or Sulfotex 110) and Component C hydrocarbon surfactants, (Glucopon 325 CS or Lonzaine CS or Deteric LP) providing low interfacial tension and foam improving properties have most of the essential properties as required of AFFF agent solutions or premixes.

As the six examples in Table 9 show, the spreading coefficients, measured against cyclohexane range from 5.3 to 7.0, exceeding military AFFF specifications MIL-F-24385 F of 3.0. Also very positive are the long seal break-up time, exceeding 30 minutes in all cases where a seal was formed. However, other properties determined varied considerably with foam expansion ratios ranging from 5.0 in tap water to 2.3 in sea water; quarter drainage times ranging from over 3 minutes to only 15 seconds and seal speeds ranging from a very fast 11 seconds to over 2 minutes. These varied results, ranging from very positive to negative, indicate that other components known in the art of AFFF formulations had to be incorporated in order to obtain balanced agent properties at lowest possible fluorochemical surfactant levels.

EXAMPLES 44 AND 45

It is well known that solvents (Component D) such as ethylene glycol monobutyl ether, diethylene glycol monobutyl ether (butyl carbitol) and others not only act as antifreeze if incorporated into AFFF agents, but also improve the foam properties of AFFF agents. Table 10 shows comparative results of concentrates containing Components A, B and C and optionally butyl carbitol (Component D) as an antifreeze and foam improver. Results in Table 10 show clearly that the addition of butyl carbitol yields good and balanced foam expansion in tap and sea water as well as improved and balanced drainage times without effecting the seal speed and only minimally effecting the seal break-up times.

TABLE 10

| | Example 44 | | Example 45 | |
|---|---|---|---|---|
| | Betaine (0.025%) | | | |
| | A-3 | | A-4 | |
| | Sulfobetaine (0.025%) | | | |
| | A-6 | | A-6 | |
| | Alkyl Sulfate 0.05% | | | |
| | Standapol LF | | Standapol LF | |
| | Cosurfactant 0.05% | | | |
| | Glucopon 325 CS | | Glucopon 325 cs | |
| | Solvent 0.48% | | | |
| | None | Butyl Carbitol | None | Butyl Carbitol |
| Expansion, Tap | 4.6 | 5.9 | 5.0 | 5.7 |
| Expansion, Sea | 2.8 | 6.3 | 2.9 | 5.9 |
| ¼ Drain Tap-Minutes | 2'24 | 5'00 | 2'31 | 4'23 |
| 1/2 Drain Sea-Minutes | 0.29 | 4'52 | 0'32 | 4'36 |
| Seal Speed Tap-Minutes | 0'14 | 0'11 | 0'11 | 0'12 |
| Seal Speed Sea-Minutes | 0'18 | 0'20 | 0'20 | 0'21 |
| Seal Breakup Tap-Minutes | >30' | >30' | >30' | >30' |
| Seal Breakup Sea-Minutes | >30' | >30' | >30' | >30' |

EXAMPLES 46–48

Table 11 shows the compositions of AFFF agent solutions containing, in addition to Components A (betaine A-3 and sulfobetaine A-6), Component B (Standapol LF), Component C (Lonzaine CS) and Component D (butyl carbitol) also Component E (Lodyne K78'220B or Lodyne S-103A/S-106A ion pair complex). Substituting part of Component

TABLE 9

| | Examples | | | | | |
|---|---|---|---|---|---|---|
| | Example 38 | Example 39 | Example 40 | Example 41 | Example 42 | Example 43 |
| | Betaine (0.025%) | | | | | |
| | A-4 | | A-4 | | A-4 | |
| | Sulfobetaine (0.025%) | | | | | |
| | A-6 | | A-6 | | A-6 | |
| | Alkyl Sulfate (0.05%) | | | | | |
| | Standapol LF | Sulfotex 110 | Standapol LF | Sulfotex 110 | Standapol LF | Sulfotex 110 |
| | Cosurfactant 0.05% | | | | | |
| | Glucopon 325 CS | | Lonzaine CS | | Deteric LP | |
| $Y_a$, dynes/cm | 15.9 | 15.9 | 15.3 | 15.8 | 15.8 | 17.3 |
| $Y_i$, dynes/cm | 1.8 | 2.9 | 3.3 | 3.5 | 1.9 | 2.1 |
| $SC_{a/b}$ | 7.0 | 5.9 | 6.1 | 5.4 | 7.0 | 5.3 |
| Expansion, Tap | 5.0 | 5.1 | 3.4 | 4.6 | 3.0 | 3.5 |
| Expansion, Sea | 2.9 | 2.9 | 3.4 | 4.2 | 3.1 | 2.3 |
| ¼ Drain, Tap - Minutes | 2'31 | 3'10 | 2'12 | 2'42 | 1'40 | 1'33 |
| ¼ Drain, Sea - Minutes | 0'32 | 0'41 | 1'33 | 2'16 | 0'39 | 0'15 |
| Seal Speed, Tap - Minutes | 0'11 | 0'18 | 0'14 | 0'42 | 2'22 | 5% |
| Seal Speed, Sea - Minutes | 0'20 | 0'13 | 0'30 | 0'38 | 60% in 2' | 5% |
| Seal Breakup Tap-Minutes | >30' | >30' | >30' | >30' | >30' | — |
| Seal Breakup Sea-Minutes | >30' | >30' | >30' | >30' | >30' | — |

A fluorochemical surfactants with Component E fluorochemical surfactants or fluorochemical synergists can improve properties such as drainage time and counteract reduced seal breakup times caused by butyl carbitol as shown in Examples 47 and 48, when certain hydrocarbon surfactants are used as Component C.

The better of the two concentrates, FX-2 met the MIL-F-24385F specifications even if diluted to a 67% FS-2 content in the 3% AFFF agent, having a fluorine content of only 0.67%.

TABLE 11

| | Example 46 | | Example 47 | | Example 48 | |
|---|---|---|---|---|---|---|
| | Betaine[1)] | | | | | |
| | A-3 | | A-3 | | A-3 | |
| | Sulfobetaine[1)] | | | | | |
| | A-6 | | A-6 | | A-6 | |
| | FC-Cosurfactant[1)] | | | | | |
| | — | | Lodyne K78'220B | | Lodyne S-103A/S-106A Complex | |
| | Alkyl Sulfate, 0.05% | | | | | |
| | Standapol LF | | Standapol LF | | | |
| | Cosurfactant, 0.05% | | | | | |
| | Lonzaine CS | | Lonzaine CS | | | |
| | Solvent, 0.48% | | | | | |
| | None | Butyl Carbitol | None | Butyl Carbitol | None | Butyl Carbitol |
| F-Expansion, Tap Water | 3.9 | 5.6 | 3.3 | 5.4 | 3.6 | 5.3 |
| F-Expansion, Sea Water | 4.5 | 5.7 | 4.7 | 5.8 | 4.1 | 5.5 |
| ¼ Drain, Tap - Minutes | 2'15 | 4'25 | 2'00 | 4'42 | 2'21 | 5'27 |
| ¼ Drain, Sea - Minutes | 2'09 | 4'52 | 2'45 | 5'08 | 1'45 | 4'21 |
| Seal, Tap - Minutes | 0'11 | 0'10 | 0'16 | 0'09 | 0'12 | 0'09 |
| Seal, Sea - Minutes | 0'19 | 0'14 | 0'29 | 0'16 | 0'18 | 0'13 |
| Seal Breakup, Tap - Minutes | >30' | 12' | >30' | >30' | 24' | >30' |
| Seal Breakup, Tap - Minutes | >30' | 16' | >30' | >30' | >30' | >30' |

1)Total FC-Solid Content: 0.05%. A-3/A-6: Solids ratio 50/50. A-3/A-6/K78'220B System: Solids ratio 45/45/10. A-3/A-6/S-103A/S-106A System: Solids ratio 42.5/42.5/11/4.

EXAMPLES 49–50

Table 12 shows the composition of Concentrates FX-1 and FX-2 based on Components A, B, D, and E and optionally an electrolyte (Component H), magnesium sulfate heptahydrate and the performance of 3% premixes with tap and sea water showing surface tensions in the 16.2 to 18.3 dynes/cm range, interfacial tensions in the 1.0 to 2.4 dynes/cm range and spreading coefficients in the 5.4 to 6.2 range, indicating that from such concentrates AFFF agents can be formulated, useful as agents for 3% or 6% proportioning as shown in the following Examples 51 to 56.

EXAMPLES 51 TO 56

Table 13 shows comparative fire test results obtained with 3% AFFF agents derived from Concentrates FX-1 and FX-2 as described in Examples 49 and 50, having a fluorine content ranging from 0.67 to 1.00% in the 3% AFFF agents. The MIL-F-24385F fire test results show that extinguishment, foam expansion, foam drainage and burnback resistance values (25% area involved in flames in burnback test) were obtained exceeding the minimum performance criteria as established by MIL-F-24385F for full strength test fires.

TABLE 12

| Concentrate Components and Performance of 3% Premixes | Composition of Concentrates | |
|---|---|---|
| | Example 49 FX-1 | Example 50 FX-2 |
| A. Components | | |
| Betaine A-3, % Solids. | 0.90 | 0.90 |
| Sulfobetaine A-6, % Solids | 0.98 | 0.98 |
| Standapol LF, % Solids | 2.10 | — |
| Sulfotex 110, % Solids | — | 1.20 |
| Lonzaine CS, % Solids | 2.00 | — |
| Glucopon 325, CS, % Solids | — | 2.50 |
| Butyl Carbitol, % | 16.00 | 16.00 |
| Magnesium Sulfate Heptahydrate, % | 1.00 | 1.00 |
| Water | 77.02 | 77.42 |
| Total Fluorine Content, % | 1.88 | 1.88 |
| B. Performance of 3% Premixes | | |
| Surface Tension $Y_a$ in Tap Water | 17.6 | 16.2 |
| Surface Tension $Y_a$ in Sea Water | 18.3 | 16.5 |
| Interfacial Tension $Y_i$ in Tap Water | 1.2 | 1.0 |
| Interfacial Tension $Y_i$ in Sea Water | 2.4 | 2.0 |

TABLE 12-continued

| Concentrate Components and Performance of 3% Premixes | Composition of Concentrates Example 49 FX-1 | Example 50 FX-2 |
|---|---|---|
| Spreading Coefficient in Tap Water | 5.9 | 5.4 |
| Spreading Coefficient in Sea Water | 6.1 | 6.2 |

EXAMPLE 57

30 gm of Concentrate FX-2 having the composition as described in Example 12 was mixed with 970 gm of tap water. Under vigorous stirring 3.11 gm of a 20% aqueous solution of Genamim PDAC (38%), a cationic polyelectrolyte [poly(diallyldimethylammoniumchloride)] was added to the FX-2 premix and a white precipitate was formed which did mostly float to and stay on top of the surface of the premix solution and did also partly adhere to the walls and bottom of the beaker used. The solids floating on the TABLE 13a Comparative MIL-F-24385F 28 sq. ft. Fire Test Evaluation of 3% AFFF Agents Derived from Concentrates FX-1 and FX-2.

| Composition and Fire Test Results of 3% AFFF Agents Derived From FX-1 and FX-2. | Concentrate FX-1 Derived 3% AFFF Agent Ex. 51 | Ex. 52 | Ex. 53 | MIL-F-24385F Specs for 3% AFFF |
|---|---|---|---|---|
| A. Composition | | | | |
| FX-Concentrate in 3% AFFF Agent (%) | 100 | 83 | 67 | NS[1)] |
| Fluorine Content 3% AFFF Agent (%) | 1.00 | 0.83 | 0.67 | NS |
| B. Fire Test Results | | | | |
| Summation of Extinguishment: | | | | |
| After 10 Seconds (%) | 80 | 70 | 60 | NS |
| After 20 Seconds (%) | 90 | 90 | 75 | NS |
| After 30 Seconds (%) | 100 | 95 | 97 | NS |
| After 40 Seconds (%) | 100 | 100 | 100 | NS |
| TOTAL | 375 | 332 | 332 | NS |
| Extinguishment (Seconds) | 26 | 38 | 37 | 30 max. |
| Foam Expansion Ratio | 7.3 | 7.14 | 6.21 | 5.0 min. |
| 25% Foam Drainage (Minutes, Seconds) | 2'41 | 2'10 | 2'10 | 2'30" min |
| Flash Over (Minutes, Seconds) | 2'20 | 1'35 | 1'15 | NS |
| 25% Area Involved (Minutes, Seconds) | 7'45 | 6'50 | 8'40[2)] | 6'0 min |

[1)]Not specified in MIL-F-24385F, but helpful for comparative evaluations.
[2)]Values too good because of wind pushing flames toward rim of pan.

TABLE 13b

Comparative MIL-F-24385F 28 sq. ft. Fire Test Evaluation of 3% AFFF Agents Derived from Concentrates FX-1 and FX-2.

| Composition and Fire Test Results of 3% AFFF Agents Derived From FX-1 and FX-2. | Concentrate FX-1 Derived 3% AFFF Agent Ex. 54 | Ex. 55 | Ex. 56 | MIL-F-24385F Specs for 3% AFFF |
|---|---|---|---|---|
| A. Composition | | | | |
| FX-Concentrate in 3% AFFF Agent (%) | 100 | 83 | 67 | NS[1)] |
| Fluorine Content 3% AFFF Agent (%) | 1.00 | 0.83 | 0.67 | NS |
| B. Fire Test Results | | | | |
| Summation of Extinguishment: | | | | |
| After 10 Seconds (%) | 85 | 80 | 70 | NS |
| After 20 Seconds (%) | 99 | 97 | 85 | NS |
| After 30 Seconds (%) | 100 | 100 | 100 | NS |
| After 40 Seconds (%) | 100 | 100 | 100 | NS |
| TOTAL | 384 | 377 | 355 | NS |
| Extinguishment (Seconds) | 24 | 23 | 29 | 30 max. |
| Foam Expansion Ratio | 7.81 | 7.58 | 7.35 | 5.0 min. |
| 25% Foam Drainage (Minutes, Seconds) | 3'25 | 2'45 | 2'35 | 2'30" min |
| Flash Over (Minutes, Seconds) | 2'20 | 1'30 | 1'35 | NS |
| 25% Area Involved (Minutes, Seconds) | 8'15 | 9'45[2)] | 6'20 | 6'0 min |

[1)]Not specified in MIL-F-24385F, but helpful for comparative evaluations.
[2)]Values too good because of wind pushing flames toward rim of pan.

surface were skimmed off, reslurried in 300 gm of water and the water siphoned off. This wash procedure was repeated three times. The washed residue was dried for two days at 80° C. until a constant weight was obtained. A total of 1.187 gm of white residue was obtained, having a fluorine content of 17.30%.

Assuming that the treatment of the FX-2 premix with the cationic polyelectrolyte did precipitate quantitatively the betaine/sulfobetaine-alkyl sulfate complex, a total of (1.16) gm of precipitate should have formed having a theoretical fluorine content of 25.86% as the following calculations show: The theoretical precipitate from 30 gm of FX-2 concentrate, diluted to a 1000 gm premix should therefore amount to the following:

| | | |
|---|---|---|
| Fluorochemical betaine/sulfobetaine solids: | 1.88% or | 0.564 gm |
| Alkyl Sulfate Sulfotex 100 Solids: | 1.20% or | 0.360 gm |
| Polyelectrolyte Genamin PDAC Solids: | 0.79% or | 0.236 gm |
| Total Solids | | 1.160 gm |
| Theoretical Fluorine Content: | | 0.3 gm or 25.86% |

The fact that the precipitate formed had only a fluorine content of 17.30%, but that a higher amount of precipitate was formed (1.187 gm plus small amounts not recovered) indicates that by treatment of the FX-2 premix with a cationic poly electrolyte a certain amount of the other surfactant present in FX-2, did coprecipitate or were adsorbed to the precipitate.

What is claimed is:

1. A fluorochemical surfactant composition providing a surface tension in water of 20 dynes/cm or below said composition comprising (i) from 5 to 95% by weight of a fluoroaliphatic amphoteric surfactant having a solubility of less than 0.01% in water at 25° C. and (ii) from 5 to 95% by weight of a water soluble, anionic surfactant.

2. The fluorochemical surfactant composition of claim 1 wherein said water-soluble, anionic surfactant is selected from the group consisting of hydrocarbon sulfate surfactant, hydrocarbon sulfonate surfactant, fluoroaliphatic sulfate surfactant, and fluoroaliphatic sulfonate surfactant.

3. The fluorochemical surfactant composition of claim 1 wherein said water-soluble, anionic surfactant is a sulfate or sulfonate of the formula $$R—L_2—Q_2$$

where

R is selected from the group consisting of straight chain perfluoroalkyl group with 3 to 18 carbon atoms, branched chain perfluoroalkyl group with 3 to 18 carbon atoms, straight alkyl with 6 to 18 carbon atoms, branched alkyl with 6 to 18 carbon atoms, alkenyl with 6 to 18 carbon atoms, cycloalkyl with 6 to 18 carbon atoms, and cycloparaffin group with 6 to 18 carbon atoms, $L_2$ is either a bond between R and $Q_2$ or a bivalent linking group, $Q_2$ is either $—SO_3M$ or $—OSO_3M$, and M is a counterion.

4. The fluorochemical surfactant composition of claim 3, wherein

R is an alkyl group with 8 to 14 carbons, $L_2$ is a bond between R and $Q_2$ or $—(OCH_2CH_2)_x—$, where x is 1 to 3, $Q_2$ is $—OSO_3M$, and M is sodium or potassium.

5. The fluorochemical surfactant composition of claim 1 wherein said fluoroaliphatic amphoteric surfactant comprises at least one surfactant of the formula $$R_f—L_1—N^+(R_1(R_2)—(CH_2)_mQ^-$$

where $R_f$ is a straight or branched chain perfluoroalkyl group with 5 to 18 carbon atoms, $L_1$ is a bivalent linking group with 1 to 4 carbon atoms, one of $R_1$ and $R_2$ is selected from the group consisting of alkyl with 1 to 4 carbon atoms and hydroxyalkyl with 1 to 4 carbon atoms, and the other one of $R_1$ and $R_2$ is selected from the group consisting of alkyl with 1 to 4 carbon atoms, hydroxyalkyl with 1 to 4 carbon atoms, and hydrogen, $Q^-$ is $—COO^-$ or $—SO_3^-$, and m is 1 to 4.

6. The fluorochemical surfactant composition of claim 5, wherein $R_f$ is a straight or branched perfluoroalkyl group with 5 to 13 carbon atoms.

7. The fluorochemical surfactant composition of claim 5, wherein $R_1$ and $R_2$ are methyl.

8. The fluorochemical surfactant composition of claim 5, wherein $L_1$ is selected from $—CHF—(CH_2)_2—$ and $—(CH_2)_3—$.

9. The fluorochemical surfactant composition of claim 5, wherein m is 1 if $Q^-$ is $—COO^-$ and 3 if $Q^-$ is $—SO_3^-$.

10. The fluorochemical surfactant composition of claim 5, wherein $R_f$ is a straight or branched perfluoroalkyl group with 5 to 13 carbon atoms, $L_1$ is $—CHF—(CH_2)_2—$ or $—(CH_2)_3—$, $R_1$ and $R_2$ are methyl, and m is 1 if $Q^-$ is $—COO^-$ and 3 if $Q^-$ is $—SO_3^-$.

11. The fluorochemical surfactant composition of claim 5, wherein said fluoroaliphatic amphoteric surfactant comprises at least one surfactant where $L_1$ is $—CHF—(CH_2)_2—$;

and, at least one surfactant where $L_1$ is $—(CH_2)_3—$.

12. The fluorochemical surfactant composition of claim 5, wherein said fluoroaliphatic amphoteric surfactant comprises at least one surfactant where $Q^-$ is $—COO^-$, and m is 1;

and, at least one surfactant where $Q^-$ is $—SO_3^-$, and m is 3.

13. An aqueous film forming concentrate composition capable upon dilution with water and upon aeration to form a fire fighting foam for extinguishing or preventing fires by suppressing the vaporization of flammable liquids, said concentrate comprising:

A) 0.5 to 10% by weight of a fluoroaliphatic amphoteric surfactant having a solubility of less than 0.01% in water at 25° C.;

B) 1.0 to 40% by weight of a water soluble, anionic surfactant selected from the group consisting of hydrocarbon sulfate surfactant, hydrocarbon sulfonate surfactant, fluoroaliphatic sulfate surfactant, and fluoroaliphatic sulfonate surfactant;

C) 0 to 40% by weight of an amphoteric hydrocarbon surfactant or a nonionic hydrocarbon surfactant;

D) 0 to 70% by weight of a water miscible solvent;

E) 0 to 3% of a fluorochemical synergist;

F) 0 to 3% of a water soluble polymeric film former;

G) 0 to 10% of a polymeric foam stabilizer;

H) 0 to 5% of a polyelectrolyte;

I) Water in the amount to make up the balance of 100%.

14. The aqueous film forming concentrate according to claim 13, comprising A) 0 5 to 4% by weight of said fluoroaliphatic amphoteric surfactant;

B) 1.0 to 20% by weight of said water soluble anionic surfactant;

C) 0 to 20% by weight of said hydrocarbon surfactant;

D) 5 to 30% by weight of said water miscible solvent;

E) 0 to 1.5% by weight of said fluorochemical synergist;

F) 0 to 1.5% of said film former;

G) 0 to 5% of said polymeric foam stabilizer;

H) 0 to 3% of a polyelectrolyte;

I) Water in the amount to make up the balance of 100%.

15. The aqueous film forming concentrate of claim 13, wherein said hydrocarbon surfactant, C), is selected from the group consisting of an amphoteric hydrocarbon surfactant containing amino and carboxy groups, an amphoteric hydrocarbon surfactant containing amino and sulfo groups, and a nonionic hydrocarbon surfactant selected from i) polyoxyethylene derivatives of alkyl phenols, ii) linear or branched alcohols, iii) fatty acids, iv) alkyl glucosides, v) alkyl polyglucosides, vi) block copolymers containing polyoxyethylene and polyoxypropylene units, and vii) mixtures thereof.

16. The aqueous film forming concentrate of claim 13, wherein said water miscible solvent is selected from the group consisting of diethylene glycol monobutyl ether, dipropylene glycol monobutyl ether, ethylene glycol and propylene glycol.

17. The aqueous film forming concentrate of claim 13, wherein said fluorochemical synergist is comprised of ion pair complexes derived from i) anionic fluorochemical surfactants and cationic fluorochemical surfactants or ii) anionic hydrocarbon surfactants and cationic fluorochemical surfactants.

18. The aqueous film forming concentrate of claim 13, wherein said polyelectrolyte is comprised of magnesium sulfate heptahydrate.

19. The aqueous film forming concentrate composition of claim 13, wherein said fluoroaliphatic amphoteric surfactant comprises at least one surfactant of the formula:

$$R_f—L_1—N^+(R_1)(R_2)—(CH_2)_mQ^-$$

wherein, $R_f$ is a straight or branched chain perfluoroalkyl group with 5 to 18 carbon atoms, $L_1$ is a bivalent linking group with 1 to 4 carbon atoms, one of $R_1$ and $R_2$ is selected from the group consisting of alkyl with 1 to 4 carbon atoms and hydroxyalkyl with 1 to 4 carbon atoms, and the other one of $R_1$ and $R_2$ is selected from the group consisting of alkyl with 1 to 4 carbon atoms, hydroxyalkyl with 1 to 4 carbon atoms, and hydrogen, $Q^-$ is $—COO^-$ or $—SO_3^-$, and m is 1 to 4.

20. The aqueous film forming concentrate of claim 19, wherein $R_f$ is a straight or branched perfluoroalkyl group with 5 to 13 carbon atoms, $L_1$ is a bivalent linking group $—CHF—(CH_2)_2—$ or $—(CH_2)_3—$;

$R_1$ and $R_2$ are methyl;

Q is $—COO^-$ or $—SO_3^-$ and m is 1 if Q is $—COO^-$ and 3 if Q is $—SO_3^-$.

21. An aqueous film forming concentrate according to claim 19, wherein said fluoroaliphatic amphoteric surfactant comprises at least one surfactant where $L_1$ is $—CHF—(CH_2)_2—$;

and, at least one surfactant where $L_1$ is $—(CH_2)_3—$.

22. The aqueous film forming concentrate according to claim 19, wherein said fluoroaliphatic amphoteric surfactant comprises at least one surfactant where $Q^-$ is $—COO^-$ and m is 1; and, at least one surfactant where $Q^-$ is $—SO_3^-$ and m is 3.

23. The aqueous film forming concentrate composition of claim 13, wherein said water soluble, anionic surfactant is of the formula:

$$R—L_2—Q_2$$

wherein

R is selected from the group consisting of straight chain perfluoroalkyl group with 3 to 18 carbon atoms, branched chain perfluoroalkyl group with 3 to 18 carbon atoms, straight alkyl with 6 to 18 carbon atoms, branched alkyl with 6 to 18 carbon atoms, alkenyl with 6 to 18 carbon atoms, cycloalkyl with 6 to 18 carbon atoms, and cycloparaffin group with 6 to 18 carbon atoms, $L_2$ is either a bond between R and $Q_2$ or a bivalent linking group, $Q_2$ is either $—SO_3M$ or $—OSO_3M$, and M is a counterion.

24. The aqueous film forming concentrate of claim 23, wherein

R is an alkyl group with 8 to 14 carbons;

$L_2$ is a bond between R and $Q_2$ or $—(OCH_2CH_2)_x—$, where x is 1 to 3, $Q_2$ is $—OSO_3M$ and M is sodium or potassium.

25. The aqueous film forming concentrate of claim 13 wherein said film former comprising a polysaccharide.

26. The aqueous film forming concentrate of claim 25, wherein said polysaccharide is a thixotropic polysaccharide.

27. The aqueous film forming concentrate of claim 13, wherein said polymeric foam stabilizer is comprised of polyvinyl alcohol and polyacrylamides.

28. The aqueous film forming concentrate of claim 27 wherein said polymeric foam stabilizer further comprises hydrolyzed protein and starches.

* * * * *